United States Patent [19]

Sprague et al.

[11] 4,028,065

[45] * June 7, 1977

[54] MANGANESE CONTAINING FUELS

[75] Inventors: James W. Sprague, Bedford; Daniel W. Feldman, Beachwood; Franklin Veatch, Cleveland, all of Ohio

[73] Assignee: Standard Oil Company, Cleveland, Ohio

[ * ] Notice: The portion of the term of this patent subsequent to June 29, 1993, has been disclaimed.

[22] Filed: Nov. 27, 1974

[21] Appl. No.: 527,676

Related U.S. Application Data

[63] Continuation-in-part of Ser. No. 470,692, May 16, 1974, Pat. No. 3,966,429.

[52] U.S. Cl. ..... 44/68; 252/386

[51] Int. Cl.[2] ..... C10L 1/18

[58] Field of Search ..... 44/68, 70; 260/429; 252/386

[56] References Cited

UNITED STATES PATENTS

| | | | |
|---|---|---|---|
| 1,995,615 | 3/1935 | Jaeger | 44/70 |
| 2,948,744 | 8/1960 | Hnizda | 44/68 |

*Primary Examiner*—Allen B. Curtis
*Assistant Examiner*—Mrs. Y. Harris-Smith
*Attorney, Agent, or Firm*—Herbert D. Knudsen; David J. Untener

[57] ABSTRACT

The invention is gasoline, containing manganese additives, to improve the octane rating of the gasoline and including a hydrocarbon ester of citric acid.

40 Claims, No Drawings

MANGANESE CONTAINING FUELS

CROSS REFERENCE TO RELATED APPLICATIONS

This application is a continuation-in-part of Ser. No. 470,692 filed May 16, 1974, now U.S. Pat. No. 3,966,429.

BACKGROUND OF THE INVENTION

It is well known that lead gasoline additives have been under attack due to environmental reasons. As a result, there has been a search for suitable octane improvers that do not employ lead. Various manganese compounds have been found and are known to improve the octane rating of gasoline compositions, see for example U.S. Pat. No. 3,127,351.

Discovery of these new manganese additives has presented additional problems in that now compatible additives must be found which alleviate problems caused by the use of manganese.

One problem encountered with the use of manganese additives is spark plug gap bridging and the resultant misfiring and engine malfunction. These misfires appear to be caused by formation during combustion of manganese containing particles which become lodged in the spark plug gap. For automobiles equipped with catalytic converters, such misfires overload the catalytic muffler with hydrocarbons to be oxidized and cause overheating of the converter. Also, the particles formed upon combustion of manganese containing fuels can cause clogging of the catalytic mufflers.

SUMMARY OF THE INVENTION

It has now been discovered that these problems of the art can be solved by the addition of a citrate compound. More specifically, the invention is gasoline containing an added manganese compound to improve the octane rating of the gasoline and including a hydrocarbon ester of citric acid.

The base fuel employed in the invention is gasoline containing a suitable manganese additive. The gasoline compositions employed in this fuel are well known in the art. The manganese compounds, although less well known, are readily available on a commercial basis. Suitable manganese compounds, such as the cyclopentadienyl manganese tricarbonyls, have been invented and publicized by various companies, especially the Ethyl Corporation. One of the most prominent of the manganese additives is methyl cyclopentadienyl manganese tricarbonyl. Use of this additive in the base fuel of the present invention is especially preferred.

The present invention is the incorporation of a citrate compound into these manganese base fuels.

The hydrocarbon ester of citric acid employed in the present invention may vary widely. Suitably, the ester may have the formula:

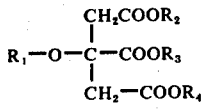

wherein $R_{1-4}$ are independently H or an alkyl, cycloalkyl, phenyl, alkylphenyl or phenylalkyl of up to 10 carbon atoms and wherein at least one of $R_{2-4}$ is a hydrocarbon. Referring to the formula, preferred citrates are described when $R_{1-4}$ are independently H or an alkyl of one to four carbon atoms and at least one of $R_{2-4}$ is an alkyl, with those citrates wherein $R_1$ is hydrogen and/or when at least two of $R_{2-4}$ re hydrocarbons.

Of greatest interest in the present invention is the trialkyl citrates. These citrates are suitably described by the formula:

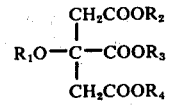

wherein $R_1$ is H or an alkyl of up to 10 carbon atoms and wherein $R_{2-4}$ are independently an alkyl radical of up to 10 carbon atoms.

Referring to the formula, preferred trialkyl citrates are described when $R_1$ is H or an alkyl of one to four carbon atoms and when $R_{2-4}$ are independently an alkyl of one to four carbons, with those citrates when $R_1$ is H being of great interest. Preferred citrates are those that contain three alkyl groups of 2 to 4 carbon atoms. These citrates are triethyl, tripiopyl and tributyl citrate, with triethyl citrate being of greatest interest.

Representative examples of the broad class of hydrocarbon esters of citric acid described above include 2-ethyoxytriethyl citrate, trimethyl citrate, methyldiphenyl citrate, cyclobutyldipropyl citrate, 2-methoxytribenzyl citrate 2-phenoxytrimethyl citrate, monotoluo citrate, dinonyl citrate and methylethylbutyl citrate. These citrates may be purchased commercially or prepared by known esterification and etherification techniques.

For the best results, the volatility and solubility of the ester is adjusted to assure that the citrate is present and volatilized at the right time. This adjustment, of course, is accomplished by altering the nature of the various substituents designated by $R_{1-4}$ until the most desirable properties are obtained. In addition to the adjustment provided by the formula, other substituents, such as chloro or bromo could be present, but for economic reasons, these substituents are less preferred.

Any amount of the citrate ester could be employed so long as the desirable results of the invention are obtained. Normally, good results are obtained using concentrations of as low as 5 mg. to about 500 mg. of the ester per gallon, with amounts of 10 to 180 mg. being preferred, especially for the most preferred citrate, triethyl citrate. At high concentrations of the ester of citric acid, problems of misfiring are again incurred.

The concentration of the manganese compound may also vary widely so long as the desired octane improvement is realized. Suitable concentrations are known in the art. For the cyclopentadienyl manganese tricarbonyl compounds suitable concentrations measured on the weight of the compound range from about 0.1 to 5 grams per gallon, with amounts within the range of 0.2 to 2 grams per gallon being preferred.

The present invention is not only directed toward the gasoline composition but also to the additive package which when combined with gasoline gives the gasoline composition discussed above. It is anticipated that this is the manner in which the invention will be sold.

The additive package broadly contains the manganese compound and ester of citric acid. Also, it would normally be expected that any other ingredients to be added to the final gasoline composition would also be present in the package. The additive package could consist of the added ingredients alone, or it could contain the additives dissolved in a solvent. The most suitable solvent is gasoline.

In the additive package, the comparative amounts of the manganese compound and ester of citric acid may vary widely depending on the final concentration desired. Normally, the weight ratio of the manganese compound to the hydrocarbon ester of citric acid ranges from 50:1 to 1:5.

In addition to the additives specifically required by the present invention, the gasoline compositions encompassed by the invention would include other additives that are known and developed which would not interfere with the functions of the additives of the invention. Thus, for example, in addition to the manganese additive and the citrate, suitably inhibitors or other additives could be employed. Specifically, it has been found that alkyl tin compounds are very suitable and desirable when the possibility of lead contamination exists.

SPECIFIC EMBODIMENTS

All examples of the present invention were run using a base fuel having an initial octane rating of about 93 R.O.N. To this fuel was added 0.2 grams per gallon of manganese as methyl cyclopentadienyl manganese tricarbonyl. In addition, the fuel contained 340 p.p.m. Ornite OGA-472 which is a detergent made of a polybutene amine, and ⅛ of one percent SEB-78 which is a lubricating oil component to maintain induction system cleanliness. This fuel exhibited at 96 R.O.N. To represent a lead contaminated fuel, 0.5 grams per gallon of lead, astetra ethyl lead, was added to this manganese fuel.

All experiments were run on a Kohler K91 engine. This engine was rated at 4 horsepower and has a single cylinder of cast iron. For evaluating resistance to misfiring, the engine was run at 3600 rpm with no added load except for an integral cooling fan. For the tests, an extended core plug of moderately high heat range was selected. This plug has a designation from AC of AC465. The heat range was suitable for turnpike as well as around-town driving conditions. The extended core was chosen to increase the test severity by exposing the plug to more of the products of combustion. To further increase the severity of the test, the electrode gap was reduced to 0.015 inches. These severe conditions were chosen to obtain the most informative test results in the shortest period of time. The results of these experiments were later confirmed on full-size automobile engines.

Each of the tests was run with a clear freshly set plug which would give reliable ignition. Each test was begun with fresh oil and a clean combustion chamber. The engine was run for a period of 19 hours to provide adequate plug deposits. Then for a period of one hour, the number of misfires were counted. In some cases, the engine stalled before a misfire count could be made. To detect misfire, the exhaust line pressure near the exhaust port was monitored with a Kistler pressure pickup. The exhaust line pressure depended on the ignition success of the plug. When a misfire occurred, a counter recorded the misfire.

Comparative Examples A-C and Examples 1-4 - Effect of triethyl citrate on the number of misfires.

The manganese fuel described above was run in the Kohler engine. It was determined that the citrate compound improved the ignition reliability of the manganese fuel. Instances of premature stalling and misfire counts in the 20the hour of over 13,000 were improved to no instances of stalling and misfire counts of less than 2000 using triethyl citrate concentrations of between 20 and 160 milligrams per gallon. The results of these tests are shown in the following Table.

Effect of Triethyl Citrate on the Number of Misfires Using a Manganese Fuel

| Example | Triethyl Citrate, mg./gal. | Misfires in 20th hour |
|---|---|---|
| Comp. A | 0 | Stalled 14.9 hours |
| Comp. B | 0 | Stalled 16.2 hours |
| Comp. C | 0 | 13,100 |
| 1 | 20 | 900 |
| 2 | 40 | 1,970 |
| 3 | 80 | 1,490 |
| 4 | 160 | 460 |

EXAMPLE 5

Effect of triethyl citrate on plug gap deposits.

The spark plugs used with the manganese fuel were examined. Deposits appeared to form on the plug electrodes as needles, extending from the center electrode towards the ground electrode. Occasionally, such needles bridged the gap completely, causing the plug to be shorted out. However, with triethyl citrate incorporated in the fuel at a level of 40 milligrams per gallon, the growth of these deposits was substantially eliminated.

EXAMPLE 6

Effect of misfires on catalytic muffler.

Using the fuel shown above, the engine is run in combination with a catalytic muffler. Without the treithyl citrate, the catalytic muffler is required to oxidize large quantities of unburnt gasoline. This burning of gasoline in the catalytic muffler causes the muffler to overheat and at least partially destroys the normal effectiveness of the catalytic muffler. With triethyl citrate, the number of misfires is reduced to the point where the catalytic muffler is not damaged.

EXAMPLE 7

Effect of particles on catalytic muffler.

Using the fuel described above, the engine is run in combination with a catalytic muffler that has small pores through which the exhaust gas must travel. Without triethyl citrate, the particles generated during combustion which cause stalling and misfire of the engine as described above, accumulate in the pores of the catalytic muffler thereby increasing the pressure drop across the muffler. Eventually, the engine becomes inoperable because of the back pressure caused by blockage of the catalytic muffler. With the triethyl citrate, essentially no increase in the pressure drop over the catalytic muffler is observed.

In the same way as shown in the examples above, triethyl citrate is replaced with tripropyl citrate, tributyl citrate, 2-methoxy methyldiphenyl citrate, dicyclohexyl citrate and other hydrocarbon esters of citric acid and the benefits of the invention are realized.

These additives are economically feasible from the cost standpoints and are not toxic to the extent that they would be precluded as gasoline additives. Above all, they are very desirable additives for gasoline containing manganese.

We claim:

1. Gasoline containing an added gasoline soluble manganese compound to improve the octane rating of the gasoline and including a small but effective amount of a gasoline soluble hydrocarbon ester of citric acid.

2. The gasoline of claim 1 wherein the hydrocarbon ester of the citric acid has the formula

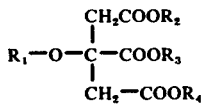

wherein $R_{1-4}$ are independently H or an alkyl, cycloalkyl, phenyl, alkylphenyl or phenylalkyl of up to 10 carbon atoms and wherein at least one of $R_{2-4}$ is a hydrocarbon.

3. The gasoline of claim 2 wherein $R_{1-4}$ are independently H or an alkyl of one to four carbon atoms and at least one of $R_{2-4}$ is an alkyl.

4. The gasoline of claim 2 wherein $R_1$ is hydrogen.

5. The gasoline of claim 2 wherein at least two of $R_{2-4}$ are hydrocarbons.

6. The gasoline of claim 1 containing 5 to 500 mg. per gallon of the hydrocarbon ester of citric acid.

7. The gasoline of claim 1 containing 10 to 180 mg. per gallon of the hydrocarbon ester of citric acid.

8. The gasoline of claim 1 wherein the manganese compound is a cyclopentadienyl manganese tricarbonyl.

9. The gasoline of claim 8 wherein the manganese compound is methylcyclopentadienyl manganese tricarbonyl.

10. Gasoline containing an added gasoline soluble manganese compound to improve the octane rating of the gasoline and including a small but effective amount of a gasoline soluble trialkyl citrate.

11. The gasoline of claim 10 wherein the trialkyl citrate has the formula

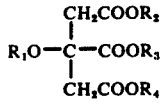

wherein $R_1$ is H or an alkyl of up to 10 carbon atoms and wherein $R_{2-4}$ are independently an alkyl radical of up to 10 carbon atoms.

12. The gasoline of claim 11 wherein $R_1$ is H or an alkyl of one to four carbon atoms and $R_{2-4}$ are independently an alkyl of one to four carbon atoms.

13. The gasoline of claim 11 wherein $R_1$ is H.

14. The gasoline of claim 13 wherein $R_{2-4}$ are independently an alkyl of one to four carbon atoms.

15. The gasoline of claim 13 wherein $R_{2-4}$ are independently an alkyl of two to four carbon atoms.

16. The gasoline of claim 10 wherein the trialkyl citrate is triethyl citrate.

17. The gasoline of claim 10 wherein the trialkyl citrate is tripropyl citrate.

18. The gasoline of claim 10 wherein the trialkyl citrate is tributyl citrate.

19. The gasoline of claim 10 wherein the trialkyl citrate is present in the amount of 5 to 500 mg. per gallon.

20. The gasoline of claim 10 wherein the triethyl citrate is present in the amount of 10 to 180 mg. per gallon.

21. The gasoline of claim 10 wherein the manganese compound is a cyclopentadienyl manganese tricarbonyl.

22. Gasoline containing cyclopentadienyl manganese tricarbonyl and triethyl citrate.

23. The gasoline of claim 22 wherein the concentration of the triethyl citrate is 5 to 500 mg. per gallon.

24. The gasoline of claim 22 wherein the concentration of the treithyl citrate is 10 to 180 mg. per gallon.

25. The gasoline of claim 22 wherein the concentration of the cylopentadienyl manganese tricarbonyl measured on the weight of the compound is 0.1 to 5 grams per gallon.

26. The gasoline of claim 22 wherein the concentration of the cyclopentadienyl manganese tricarbonyl measured on the weight of the compound is 0.2 to 2 grams per gallon.

27. The gasoline of claim 22 wherein the concentration of the cyclopentadienyl tricarbonyl manganese tricarbonyl is 0.2 to 2 grams per gallon, and the concentration of the triethyl citrate is 10 to 180 mg. per gallon.

28. An additive package for gasoline comprising a gasoline soluble manganese compound to improve the octane rating of the gasoline and a gasoline soluble ester of citric acid.

29. The additive package of claim 28 wherein the manganese compound is a cyclopentadienyl manganese tricarbonyl.

30. The additive package of claim 28 wherein the manganese compound is a methylcyclopentadienyl manganese tricarbonyl.

31. The additive package of claim 28 wherein the hydrocarbon ester of citric acid has the formula

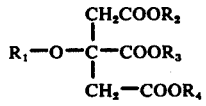

wherein $R_{1-4}$ are independently H or an alkyl, cycloalkyl, phenyl, alkylphenyl or phenylalkyl of up to 10 carbon atoms and wherein at least one of $R_{2-4}$ is a hydrocarbon.

32. The additive package of claim 31 wherein $R_1$ is H, $R_{2-4}$ are independently an alkyl of one to four carbon atoms and at least one of $R_{2-4}$ is an alkyl.

33. The additive package of claim 32 wherein each of $R_{2-4}$ is independently an alkyl of one to four carbon atoms.

34. The additive package of claim 28 wherein the weight ratio of the manganese compound to the hydrocarbon ester of citric acid is 50:1 to 1:5.

35. An additive package for gasoline comprising methylcylcopentadienyl manganese tricarbonyl and triethyl citrate.

36. The additive package of claim 35 wherein the weight ratio of methylcyclopentadienyl manganese tricarbonyl to triethyl citrate is 50:1 to 1:5.

37. In a gasoline composition for combustion in a gasoline internal combustion engine comprising gasoline and a gasoline soluble manganese compound as an additive, the improvement comprising including a small but effective amount of a citrate compound having at least one alkyl group, said compound being soluble in gasoline and acting as a gasoline additive to improve the performance of the gasoline internal combustion engine.

38. The composition of claim 37 wherein the alkyl citrate has an alkyl group of 2-4 carbon atoms.

39. The composition of claim 37 wherein the alkyl citrate is triethyl citrate.

40. The composition of claim 37 wherein the manganese compound is methyl cyclopentadienyl manganese tricarbonyl.

* * * * *